US007220071B2

(12) United States Patent
Baker et al.

(10) Patent No.: US 7,220,071 B2
(45) Date of Patent: May 22, 2007

(54) APPARATUS AND METHOD FOR HANDLING LINERLESS LABEL TAPE

(75) Inventors: Daniel D. Baker, St. Paul, MN (US); Lloyd S. Vasilakes, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 23 days.

(21) Appl. No.: 11/114,354

(22) Filed: Apr. 25, 2005

(65) Prior Publication Data

US 2005/0186009 A1 Aug. 25, 2005

Related U.S. Application Data

(62) Division of application No. 10/627,431, filed on Jul. 25, 2003, now Pat. No. 6,910,820.

(51) Int. Cl.
*B41J 11/00* (2006.01)

(52) U.S. Cl. ..... 400/611; 400/613; 400/659; 347/215; 347/219

(58) Field of Classification Search ..... 400/611, 400/617, 618, 621, 613; 347/219, 220
See application file for complete search history.

(56) References Cited

U.S. PATENT DOCUMENTS

| | | | |
|---|---|---|---|
| 2,492,908 | A | 12/1949 | Von Hofe |
| 2,532,011 | A | 11/1950 | Dahlquist et al. |
| 2,607,711 | A | 8/1952 | Hendricks |
| 2,788,625 | A | 4/1957 | Larsen et al. |
| 2,990,081 | A | 6/1961 | DeNeui et al. |
| 3,561,190 | A | 2/1971 | Derenthal |

(Continued)

FOREIGN PATENT DOCUMENTS

| | | | |
|---|---|---|---|
| CH | 687 193 | A5 | 10/1996 |

(Continued)

OTHER PUBLICATIONS

3M Innovative Properties Co., "3M-Matic™ Corner Label Applicator CA2000" Brochure, © 1999.

(Continued)

*Primary Examiner*—Judy Nguyen
*Assistant Examiner*—N. Ha

(57) ABSTRACT

An apparatus for printing on a continuous web of linerless tape defined by a print side for subsequent application to an article. In one embodiment, the apparatus includes a support for a continuous web of linerless tape; an undriven platen roller located downstream of the support; a print head associated with the undriven platen roller, wherein the undriven platen roller directs the continuous web of linerless tape past the print head for printing on the print side thereof; and a driven roller positioned adjacent the platen roller and downstream of the print head for pulling the web of linerless tape from the platen roller. In another embodiment, the apparatus includes a support for a continuous web of linerless tape; a driven platen roller located downstream of the support; a print head associated with the platen roller, wherein the platen roller directs the continuous web of linerless tape past the print head for printing on the print side thereof; and a driven roller positioned adjacent the platen roller and downstream of the print head for pulling the web of linerless tape from the platen roller. Methods of printing indicia on a continuous web of linerless tape are also included.

19 Claims, 4 Drawing Sheets

U.S. PATENT DOCUMENTS 3,616,086 A 10/1971 Nooder
3,657,051 A 4/1972 McCarthy
3,905,859 A 9/1975 Patterson
3,963,557 A 6/1976 Patterson
4,001,072 A 1/1977 deNeui
4,072,224 A 2/1978 Barnaby et al.
4,101,366 A 7/1978 Teraoka et al.
4,161,138 A 7/1979 Marchetti
4,200,483 A 4/1980 Hoveler
4,227,955 A 10/1980 Woods et al.
4,256,528 A 3/1981 Patterson
4,295,915 A 10/1981 Sakaguchi et al.
4,321,103 A 3/1982 Lindstrom et al.
4,388,143 A 6/1983 Buchholz et al.
4,389,009 A 6/1983 Yamashita
4,421,817 A 12/1983 Pina et al.
4,427,144 A 1/1984 Macgrory et al.
4,432,830 A 2/1984 Jue
4,561,921 A 12/1985 Treiber
4,577,199 A 3/1986 Saiki et al.
4,676,859 A 6/1987 Cleary, Jr. et al.
4,685,815 A 8/1987 Baranyi
4,707,211 A 11/1987 Shibata
4,717,621 A 1/1988 So et al.
4,784,714 A 11/1988 Shibata
4,807,177 A 2/1989 Ward
4,815,871 A 3/1989 McGourty et al.
4,839,742 A 6/1989 Nakatani et al.
4,857,134 A 8/1989 Lin
4,889,581 A 12/1989 Ulrich et al.
5,035,521 A 7/1991 Stone
5,037,219 A 8/1991 Duport
5,040,461 A 8/1991 Van-Ocker
5,056,142 A 10/1991 Lapointe et al.
5,085,918 A 2/1992 Rajan et al.
5,121,586 A 6/1992 Focke
5,153,842 A 10/1992 Dlugos, Sr. et al.
5,168,814 A 12/1992 Kuzuya et al.
5,173,140 A 12/1992 Vasilakes
5,191,193 A 3/1993 Le Roux
5,193,926 A 3/1993 Kuzuya et al.
5,209,808 A 5/1993 Booth
5,227,002 A 7/1993 Faust et al.
5,228,943 A 7/1993 Vasilakes
5,229,587 A 7/1993 Kimura et al.
5,232,539 A 8/1993 Carpenter et al.
5,242,888 A 9/1993 Atherton et al.
5,261,996 A 11/1993 Rossini
5,286,332 A 2/1994 Rossini
5,292,713 A 3/1994 Stenzel et al.
5,295,753 A 3/1994 Godo et al.
5,302,034 A 4/1994 Kitazawa
5,304,264 A 4/1994 Wehrmann
5,308,173 A 5/1994 Amano et al.
5,310,036 A 5/1994 Hell
5,339,073 A 8/1994 Dodd et al.
5,342,461 A 8/1994 Murphy
5,354,588 A 10/1994 Mitchell et al.
5,376,418 A 12/1994 Rogers et al.
5,378,575 A 1/1995 Rajan et al.
5,379,962 A 1/1995 Albrecht et al.
5,399,036 A 3/1995 Yamaguchi
5,405,482 A 4/1995 Morrissette et al.
5,419,648 A 5/1995 Nagao et al.
5,425,823 A 6/1995 Woodside, III
5,431,763 A 7/1995 Bradshaw
5,437,228 A 8/1995 Uland
5,443,318 A 8/1995 Kitazawa
5,469,363 A 11/1995 Saliga
5,482,593 A 1/1996 Kuhn et al.
5,487,337 A 1/1996 Uland
5,494,360 A 2/1996 Watanabe et al.
5,497,701 A 3/1996 Uland
5,503,485 A 4/1996 Nakazato
5,507,907 A 4/1996 Kropp et al.
5,524,996 A 6/1996 Carpenter et al.
5,531,853 A 7/1996 Cubow et al.
5,539,775 A 7/1996 Tuttle et al.
5,540,369 A 7/1996 Boreali et al.
5,540,795 A 7/1996 Franklin et al.
5,549,783 A 8/1996 Schroeder et al.
5,552,994 A 9/1996 Cannon et al.
5,560,293 A 10/1996 Boreali et al.
5,569,515 A 10/1996 Rice, II et al.
5,600,563 A 2/1997 Cannon et al.
5,614,928 A 3/1997 Matsuda
5,629,981 A 5/1997 Nerlikar
5,658,647 A 8/1997 Magill et al.
5,661,099 A 8/1997 Mitchell, Jr.
5,674,345 A 10/1997 Nash
5,674,626 A 10/1997 Khatib et al.
5,675,369 A 10/1997 Gaskill
5,685,814 A 11/1997 Le
5,730,831 A 3/1998 Jensen, Jr. et al.
5,750,004 A 5/1998 Wurz et al.
5,768,384 A 6/1998 Berson
5,782,496 A 7/1998 Casper et al.
5,787,174 A 7/1998 Tuttle
5,832,827 A 11/1998 Pistro et al.
5,843,252 A 12/1998 Murphy
5,853,117 A 12/1998 Traise
5,857,789 A 1/1999 Day et al.
5,862,325 A 1/1999 Reed et al.
5,874,499 A 2/1999 Shipston et al.
5,879,507 A 3/1999 Schroeder et al.
5,897,741 A 4/1999 Mills et al.
5,915,864 A 6/1999 Austin et al.
5,935,217 A 8/1999 Sakai et al.
5,940,107 A 8/1999 Fox
5,971,437 A 10/1999 Sakashita
5,974,441 A 10/1999 Rogers et al.
5,982,284 A 11/1999 Baldwin et al.
5,997,193 A 12/1999 Petterutti et al.
6,002,344 A 12/1999 Bandy et al.
6,004,424 A 12/1999 Faust
6,006,808 A 12/1999 Ewert et al.
6,007,263 A 12/1999 Imai et al.
6,049,347 A 4/2000 Ewert et al.
6,067,103 A 5/2000 Ewert et al.
6,067,773 A 5/2000 Le
6,073,140 A 6/2000 Morgan et al.
6,088,717 A 7/2000 Reed et al.
6,125,374 A 9/2000 Terry et al.
6,141,654 A 10/2000 Heiden et al.
6,167,442 A 12/2000 Sutherland et al.
6,182,730 B1 2/2001 Muir
6,199,614 B1 3/2001 Snyder et al.
6,273,170 B1 8/2001 Finn et al.
6,280,544 B1 8/2001 Fox et al.
6,313,861 B2 * 11/2001 Schartner ..... 347/219
6,357,941 B1 * 3/2002 Amano et al. ..... 60/761
6,415,842 B1 7/2002 Vasilakes et al.
6,537,406 B1 3/2003 Jensen, Jr. et al.
6,652,172 B2 11/2003 Wood et al.
2001/0017322 A1 8/2001 Duldhardt
2002/0057300 A1 5/2002 Baker et al.
2002/0090244 A1 7/2002 Wood et al.
2003/0004946 A1 1/2003 VanDenAvnod et al.
2003/0192639 A1 10/2003 Mitchell et al.

FOREIGN PATENT DOCUMENTS

DE 32 34 556 A1 5/1984
DE 37 27 667 A1 3/1989

| | | | | |
|---|---|---|---|---|
| DE | 43 41 880 | | 12/1993 | |
| DE | 44 12 091 | A1 | 10/1995 | |
| DE | 195 35 535 | A1 | 3/1997 | |
| DE | 196 09 431 | A1 | 9/1997 | |
| EP | 0 083 404 | A1 | 7/1983 | |
| EP | 0 096 841 | | 12/1983 | |
| EP | 0 030 381 | | 6/1985 | |
| EP | 0 170 172 | A1 | 2/1986 | |
| EP | 0 316 215 | | 5/1989 | |
| EP | 0 579 423 | A1 | 1/1994 | |
| EP | 0 637 547 | A1 | 2/1995 | |
| EP | 0 673 007 | A2 | 9/1995 | |
| EP | 0 673 839 | A1 | 9/1995 | |
| EP | 0 688 008 | A1 | 12/1995 | |
| EP | 0 710 934 | A2 | 5/1996 | |
| EP | 0 758 777 | A2 | 2/1997 | |
| EP | 0 763 471 | A1 | 3/1997 | |
| EP | 0 834 404 | A2 | 4/1998 | |
| EP | 0 854 051 | A1 | 7/1998 | |
| EP | 0 889 448 | A2 | 1/1999 | |
| EP | 0 969 433 | A2 | 1/2000 | |
| EP | 0 982 688 | A1 | 3/2000 | |
| EP | 0 996 084 | A2 | 4/2000 | |
| FR | 2 697 929 | | 5/1994 | |
| FR | 2 764 977 | | 12/1998 | |
| GB | 1 323 552 | | 7/1973 | |
| GB | 2 243 135 | A | 10/1991 | |
| GB | 2 325 453 | A | 11/1998 | |
| JP | 57-32990 | | 2/1982 | |
| JP | 03-128267 | * | 5/1991 | ..... 400/617 |
| JP | 10/10143 | | 4/1998 | |
| JP | 2000-219432 | | 8/2000 | |
| JP | 2000-247508 | | 9/2000 | |
| JP | 2001-096814 | | 4/2001 | |
| JP | 2002-02026 | | 1/2002 | |
| WO | WO 92/07347 | | 4/1992 | |
| WO | WO 93/09195 | | 5/1993 | |
| WO | WO 95/31800 | | 11/1995 | |
| WO | WO 96/10489 | | 4/1996 | |
| WO | WO 96/21557 | | 7/1996 | |
| WO | WO 96/26864 | | 9/1996 | |
| WO | WO 96/40508 | | 12/1996 | |
| WO | WO 97/05021 | | 2/1997 | |
| WO | WO 97/10148 | | 3/1997 | |
| WO | WO 97/14616 | | 4/1997 | |
| WO | WO 97/15501 | | 5/1997 | |
| WO | WO 97/43744 | | 11/1997 | |
| WO | WO 97/46389 | | 12/1997 | |
| WO | WO 98/42578 | | 10/1998 | |
| WO | WO 99/05659 | | 2/1999 | |
| WO | WO 99/20468 | | 4/1999 | |
| WO | WO 99/54860 | | 10/1999 | |
| WO | WO 99/61322 | | 12/1999 | |
| WO | WO 99/65006 | | 12/1999 | |
| WO | WO 00/10122 | | 2/2000 | |
| WO | WO 00/10144 | | 2/2000 | |
| WO | WO 00/34131 | | 6/2000 | |
| WO | WO 00/42569 | | 7/2000 | |
| WO | WO 00/47410 | | 8/2000 | |
| WO | WO 00/67153 | | 11/2000 | |
| WO | WO 00/76853 | A1 | 12/2000 | |
| WO | WO 01/10472 | | 2/2001 | |
| WO | WO 01/10473 | | 2/2001 | |
| WO | WO 01/10474 | | 2/2001 | |
| WO | WO 01/10475 | | 2/2001 | |
| WO | WO 01/10476 | | 2/2001 | |
| WO | WO 01/74667 | A1 | 10/2001 | |
| WO | WO 01/96184 | A1 | 12/2001 | |
| WO | WO 02/053390 | | 7/2002 | |

OTHER PUBLICATIONS

3M-Matic as PS2000 Print & Seal Applicator.

3M, "3M-Matic™ Tape Application Sensor Kit, Type 19300".

3M, 3M-Matic™ S-857 'L' Clip Applicator, Type 29500 Instructions and Parts, © 1998.

ETIPACK Labeling and Coding Systems, "Strappy", Brochure.

ETIPACK Labeling and Coding Systems, "Drinfit, Drinjet, Drinedge, AP Euro", Brochure.

Finkenzeller; "RFID Handbook—Radio-Frequency Identification Fundamentals and Applications"; 1999; pp. 151-158 and Table 14.1 (pp. 278-287).

Schneier, Bruce; Applied Cryptography, Protocols, Algorithms, and Source Code in C; 1996 (2nd Edition); pp. 442-445.

Menezes et al.; Handbook of Applied Cryptography; 1997; pp. 349-349.

Web pages from Texas Instruments Incorporated relating to TIRIS Tag-It™—The New World of Smart Labels; 1998; consisting of 8 pages.

Web pages from Zebra Technologies relating to model 110PAX3 Series, Dec. 2, 2003, consisting of 2 pages.

Web page from Datamax Corporation relating to model PE4X print engine, Dec. 2, 2003, consisting of 1 page.

US 4,909,885, 03/1990, Swenson (withdrawn)

* cited by examiner

APPARATUS AND METHOD FOR HANDLING LINERLESS LABEL TAPE

CROSS REFERENCE TO RELATED APPLICATIONS

This application is a divisional of U.S. Ser. No. 10/627,431, filed Jul. 25, 2003, now U.S Pat. No. 6,910,820, the disclosure of which is herein incorporated by reference.

TECHNICAL FIELD

The present invention relates to systems for handling linerless tape. More specifically, the present invention relates to a method and apparatus for handling and printing on thin, linerless label tape, such as with a linerless label printer.

BACKGROUND OF THE INVENTION

Containers, packages, cartons, and cases, (generally referred to as "boxes") generally display information about the contents. This information most commonly located on the box might include lot numbers, date codes, product identification information, and bar codes. The information can be placed onto the box using a number of methods. These include preprinting the box when it is manufactured, printing this information onto the box at the point of use with an inkjet code that sprays a pattern of ink dots to form the image, or by using a flexographic ink rolling coding system. Other approaches include the use of labels, typically white paper with preprinted information either applied manually, or with an online automatic label applicator.

A recent trend in conveying information related to the product is the requirement to have the information specific for each box. For example, each box can carry specific information about its contents and the final destination of the product, including lot numbers, serial numbers, and customer order numbers. The information is typically provided on labels that are customized and printed on demand at the point of application onto the box. This is typically known as the ability to print "variable" information onto a label before it is applied onto the box. Two patents that disclose printed labels are U.S. Pat. Nos. 5,292,713 and 5,661,099.

One system for printing variable information involves thermal transfer ink printing onto labels using an ink ribbon and a special heat transfer print head. A computer controls the print head by providing input to the head, which heats discrete locations on the ink ribbon. The ink ribbon directly contacts the label so that when a discrete area is heated, the ink melts and is transferred to the label. Another approach using this system is to use labels that change color when heat is applied (direct thermal labels). In another system, variable information is directly printed onto a box or label by an inkjet printer including a print head. A computer can control the ink pattern sprayed onto the box or label.

Both thermal transfer and inkjet systems produce sharp images. Inkjet systems include piezo, thermal, continuous, and drop-on-demand. With both inkjet and thermal transfer systems, the print quality depends on the surface on which the ink is applied. It appears that the best system for printing variable information is one in which the ink and the print substrate can be properly matched to produce a repeatable quality image, especially bar codes, that must be read by an electronic scanner with a high degree of reliability.

Regardless of the specific printing technique, the printing apparatus includes a handling system for guiding a continuous web of label tape (or "label tape") to the print head, as well as away from the print head following printing for subsequent placement on the article of interest (for example, a box). To this end, the web of label tape is normally provided in a rolled form ("tape supply roll"), such that the printing device includes a support that rotatably maintains the tape supply roll. Further, a series of guide components, such as rollers, transfer plates, festoons, etc., are utilized to establish a desired tape path both upstream and downstream of the print head, with the terms "upstream" and "downstream" in reference to a tape transport path initiating at the tape supply roll and terminating at the point label application to the article of interest (e.g., a box). An exact configuration of the guide components is directly related to the form of the label tape.

In particular, label tape is provided as either a linered tape or as a linerless tape. As suggested by its name, linered tape includes both a tape defined by a print side and an adhesive side, and a release liner encompassing the adhesive side. The liner serves as the carrier for the label tape. With this configuration, the printing device normally includes components that, in addition to delivering the web to and from the print head, also peel the liner away from the label tape. While widely accepted, linered tape material is relatively expensive due to the cost associated with inclusion of the release liner. Further, the liner adds to the overall thickness, thereby decreasing the available length of label tape for a given tape supply roll diameter. A decreased label tape length requires more frequent changeovers of the tape supply roll (where the exhausted tape supply roll is replaced by a new roll), and therefore a loss in productivity. Additionally, because the liner material is typically paper, resultant fibers, debris, and dust can contaminate the printing mechanism, potentially resulting in a reduced print head life. Also, a die cut operation is typically performed on the label stock to generate labels of discrete size. The die cut operation is an additional manufacturing step (and therefore expense), and prevents implementation of a variable label length processing approach.

To overcome the above-described problems associated with linered label tape, a linerless format has been developed. Generally speaking, linerless label tapes are similar to the linered configuration, except that the liner is no longer included. Thus, the linerless label tape is defined by a non-adhesive side formulated to receive printing ("print side") and an opposing side that carries an adhesive ("adhesive side"). By eliminating the liner, linerless label tapes have a greatly increased length for a given roll diameter, and eliminate many of the other above-listed processing concerns associated with linered label tape. However, certain other handling issues are presented.

As the web of linerless tape is pulled or extended from the supply roll, the adhesive side is exposed and will readily adhere to contacted surfaces, in particular the guide components associated with the printing device and tape handling device. A common difficulty encountered in the handling of linerless label tape is "wrap-around", whereby the web adheres to and wraps around a roller otherwise in contact with the adhesive side. For example, with thermal transfer printing, a platen roller is normally associated with the print head for supporting the label tape during printing by the print head. In this regard, the adhesive side of the linerless tape is in contact with, and carried by, the platen roller. Invariably, instead of simply releasing from the platen roller, the adhesive side adheres to and wraps around the platen roller. This highly undesirable situation leads to printer malfunctions, such as misprinting, tape jams, etc.

Wrap-around of the platen roller is most commonly found in printing devices conforming with "next label segment out" protocol where, after the label is printed, it is immediately cut and applied to the article in question. In other words, there is no accumulation of printed labels between the print head and the application device. More importantly, unlike a "loose loop" system where printed labels accumulate prior to cutting and thus includes guide components, such as festoons, to tension the linerless label tape off of the platen roller, a "next label segment out" configuration has a very limited tape path length following printing along which a tension-supplying device(s) can be included.

Efforts have been made to address the "wrap-around" concern associated with linerless label tape in next label segment out printing systems, including those described in U.S. Pat. Nos. 5,674,345; 5,524,996; 5,487,337; 5,497,701; and 5,560,293. In summary, each of these references incorporates a device, such as a stripper bar, a stripper plate, or an air source, that interacts with the linerless label tape after it has undesirably adhered to the platen roller. That is to say, the common technique for addressing platen roller wrap-around is to position a device adjacent the platen roller that effectively "scrapes" the linerless label tape off of the platen roller in the event of platen roller wrap-around.

The above-described techniques for overcoming platen roller wrap-around rely upon the linerless label tape in question being relatively thick or rigid. In this regard, most available linerless label tapes have thicknesses in excess of about 100 microns (4 mils) and are paper-based. More recently, thin, plastic-based (e.g., polypropylene) linerless label tapes have become available. These types of linerless label tapes exhibit better dimensional stability with changes in humidity, and are less expensive than paper-based linerless tapes of a comparable quality. In addition, the plastic-based, linerless label tapes are comparatively thinner, thereby providing an increased web length on a roll of given diameter, and are generally less costly. As a point of reference, recently available linerless label tapes have a thickness of less than about 90 microns (3.5 mils), as thin as approximately 50 microns (2 mils). With this reduction in thickness, these new linerless label tapes are less rigid (or "flimsier") as compared to standard paper-based, or higher gauge plastic film-based, linerless label tapes. Due to the reduced rigidity, available techniques for removing the linerless label tape from the platen roller are not reliable. In fact, many current linerless label tape handling systems experience wrap-around when handling adhesive-coated polypropylene linerless label tapes having thicknesses of less than or equal to approximately 90 microns (3.5 mils).

Other efforts have been made to address the "wrap-around" concern associated with linerless label tape in printing systems, such as those described in U.S. Pat. Nos. 5,437,228; 5,487,337; 5,940,107; 5,879,507; PCT Publication WO 02/053390; EP 0637547 B1; and EP 0834404.

Various apparatuses and methods for printing on tape and applying a length of printed tape to articles are known in the art. For example, apparatuses for printing and applying tape are described in U.S. Pat. No. 6,049,347 (Ewert et al.), "Apparatus for Variable Image Printing on Tape," U.S. Pat. No. 6,067,103 (Ewert et al.) "Apparatus and Process for Variable Image Printing on Tape," PCT Publication WO 98/42578 (Lenkl) "Device and Method for Applying Linerless Labels," and PCT Publication WO 00/34131 (Faust et al.) "Variably Printed Tape And System For Printing And Applying Tape Onto Surfaces." 3M Company located in St. Paul, Minn. has sold print and apply case sealing applicators and print and apply corner sealing applicators under the brand name 3M-Matic as CA2000 Corner Label Applicator and PS2000 Print & Seal Applicator.

High volume label printing systems continue to evolve. Recent enhancements to label tapes, and in particular linerless label tapes, present handling concerns not satisfactorily resolved by existing designs. Therefore, a need exists for a method and apparatus for handling linerless label tapes within a printing device, including elimination of platen roller wrap-around.

SUMMARY OF THE INVENTION

One aspect of the present invention provides an apparatus for printing on a continuous web of linerless tape for subsequent application to an article, where the continuous web of linerless tape defined by a print side and an adhesive side. The apparatus comprises: a support for a continuous web of linerless tape; an undriven platen roller located downstream of the support; a print head associated with the undriven platen roller, where the undriven platen roller directs the continuous web of linerless tape past the print head for printing on the print side thereof; and a driven roller positioned adjacent the platen roller and downstream of the print head for pulling the web of linerless tape from the platen roller.

In one preferred embodiment of the above apparatus, the adhesive side carries an adhesive, where the driven roller includes a contact surface for engaging the linerless tape, and where the contact surface is configured to minimize adhesion with the adhesive side. In one aspect of this embodiment, the contact surface includes a knurled surface for minimizing a surface area of the contact surface.

In another preferred embodiment of the above apparatus, the apparatus is configured to process linerless tape having a thickness less than 90 microns. In another preferred embodiment of the above apparatus, the driven roller is positioned relative to the platen roller to define a wrap angle of the web of linerless tape around the driven roller of between 10°–180°. In yet another preferred embodiment of the above apparatus, the print head is a thermal transfer print head and the apparatus further comprises a ribbon, passed between the print head and the web of linerless tape for printing on the print side thereof. In another preferred embodiment of the above apparatus, the platen roller is beneath opposite the print head for supporting the linerless tape during a printing operation.

Another aspect of the present invention provides an alternative apparatus for printing on a continuous web of linerless tape for subsequent application to an article, where the continuous web of linerless tape defined by a print side and an adhesive side. The apparatus comprises: a support for a continuous web of linerless tape; a driven platen roller located downstream of the support; a print head associated with the driven platen roller, where the driven platen roller directs the continuous web of linerless tape past the print head for printing on the print side thereof; and a driven roller positioned adjacent the platen roller and downstream of the print head for pulling the web of linerless tape from the platen roller.

In one preferred embodiment of the above apparatus, the apparatus of further comprises a belt connecting the driven roller and the driven platen roller, and a first drive motor for rotating either the platen roller or the driven roller. In another preferred embodiment of the above apparatus, the apparatus further comprises a first drive motor for rotating the driven platen roller and a second drive motor for rotating the driven roller. In one aspect of this embodiment, the first drive motor rotates the platen roller a first surface speed, where the second drive motor rotates the driven roller a second surface speed, and where the second surface speed is greater than or equal to the first surface speed. In another aspect of this embodiment, when the printer is printing, the first drive motor rotates the platen roller and the second drive motor does not rotate the driven roller, and where when the printer is not printing, the first drive motor does not rotate the drive motor and the second drive motor rotates the driven roller. In yet another aspect of this embodiment, after the printer stops printing, the print head moves away from the platen roller.

In another preferred embodiment of the above apparatus, the driven roller is rotated at a surface speed greater than or equal to that of the driven platter roller. In another preferred embodiment of the above apparatus, the adhesive side carries an adhesive, where the driven roller includes a contact surface for engaging the linerless tape, and where the contact surface is configured to minimize adhesion with the adhesive side. In another aspect of this embodiment, the contact surface includes a knurled surface for minimizing a surface area of the contact surface.

In another preferred embodiment of the above apparatus, the apparatus is configured to process linerless tape having a thickness less than 90 microns. In another preferred embodiment of the above apparatus, the driven roller is positioned relative to the platen roller to define a wrap angle of the web of linerless tape along the platen roller between 10°–180°. In yet another preferred embodiment of the above apparatus, the print head is a thermal transfer print head and the apparatus further comprises a ribbon, passed between the print head and the web of linerless tape for printing on the print side thereof. In another preferred embodiment of the above apparatus, the platen roller is beneath opposite the print head for supporting the linerless tape during a printing operation. In yet another preferred embodiment of the above apparatus, the apparatus further comprise: a one-way clutch bearing in the driven platen roller; and a one-way clutch bearing in the driven roller.

Another aspect of the present invention provides a method of printing indicia on a continuous web of linerless tape for subsequent application to an article, where the web of linerless tape defined by a print side and an adhesive side. The method comprises: providing a print head associated with an undriven platen roller; providing a driven roller, positioned adjacent the platen roller downstream of the print head; providing a continuous web of linerless tape; extending the web of linerless tape along a tape path from the undriven platen roller to the driven roller such that the undriven platen roller contacts the adhesive side and the driven roller contacts the adhesive side; driving the web of linerless tape past the print head; rotating the driven roller to drive the web of linerless tape past the print head and to pull a portion of the web of linerless tape from the platen roller; and printing indicia on the print side with the print head.

In a preferred embodiment of the above method, the method includes providing a continuous web of linerless tape includes providing a web of linerless tape having a thickness of less than about 90 microns. In another preferred embodiment of the above method, the method includes providing a web of linerless tape includes providing a web of linerless tape carrying an adhesive on the adhesive side. In yet another preferred embodiment of the above method, the method includes extending the web of linerless tape along a tape path includes establishing a wrap angle of linerless tape around the driven roller between 10°–180°. In another preferred embodiment of the above method, the printing device is a thermal transfer printer and further includes a continuous ribbon disposed between the print head and the print side of the web of linerless tape. In another preferred embodiment of the above method, the method includes, the adhesive side carries an adhesive, and where the driven roller includes a contact surface for engaging the linerless tape, the contact surface being configured to minimize adhesion with the adhesive side. In another preferred embodiment of the above method, the contact surface includes a knurled surface for minimizing the surface area of the contact surface.

Another aspect of the present invention provides an alternative method of printing indicia on a continuous web of linerless tape for subsequent application to an article, where the web of linerless tape defined by a print side and an adhesive side. The method comprises: providing a print head associated with a driven platen roller; providing a driven roller, the driven roller positioned adjacent the platen roller downstream of the print head; providing a continuous web of linerless tape; extending the web of linerless tape along a tape path from the platen roller to the driven roller such that the platen roller contacts the adhesive side and the driven roller contacts the adhesive side; driving the platen roller to pull the web of linerless tape past the print head when the print head is printing indicia on the print side of the linerless tape; and driving the driven roller to pull a portion of the web of linerless tape from the platen roller when the print head is not printing indicia on the print side of the linerless tape.

In a preferred embodiment of the above method, the method further comprises: providing a first drive motor attached to the platen roller for rotating the platen roller and providing a second drive motor attached to the driven roller for rotating the drive roller. In one aspect of this embodiment, the first drive motor rotates the platen roller at a first surface speed, where the second drive motor rotates the driven roller at a second surface speed, and where the second surface speed is greater than or equal to the first surface speed.

In another preferred embodiment of the above method, the adhesive side carries an adhesive, and where the driven roller includes a contact surface for engaging the linerless tape, the contact surface being configured to minimize adhesion with the adhesive side. In one aspect of this embodiment, the contact surface includes a knurled surface for minimizing the surface area of the contact surface.

In another preferred embodiment of the above method, the method includes providing a continuous web of linerless tape includes providing a web of linerless tape having a thickness of less than about 90 microns. In one aspect of this embodiment, the method includes extending the web of linerless tape along a tape path includes establishing a wrap angle of linerless tape around the driven roller of between 10°–180°.

In yet another preferred embodiment of the above method, the printing device is a thermal transfer printer and further includes a continuous ribbon disposed between the print head and the print side of the web of linerless tape. In another preferred embodiment, the method further comprises moving the print head away from the platen roller after the print head stops printing.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

Figure 1:
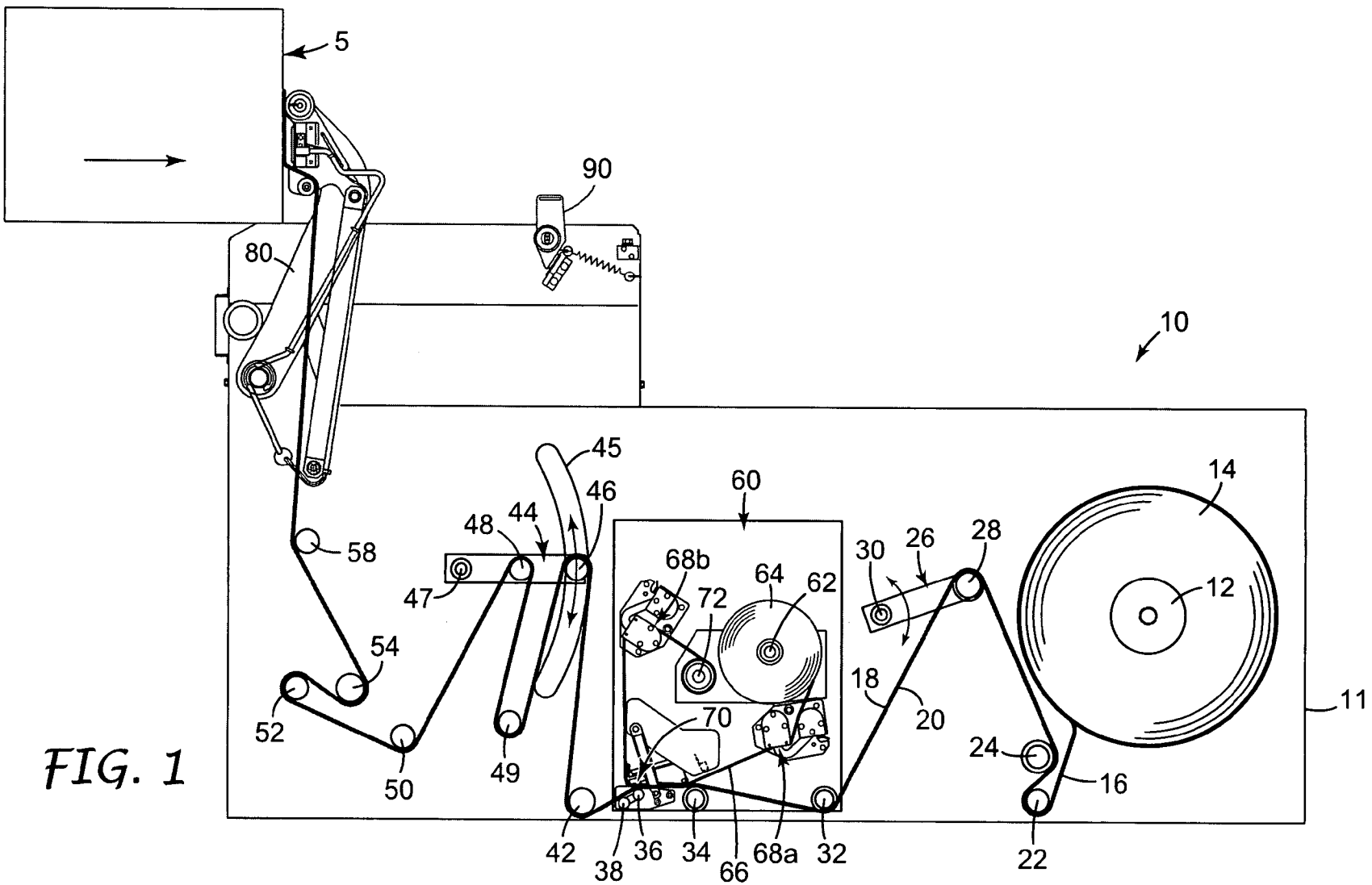
FIG. 1 is a schematic, top view of one embodiment of an apparatus for printing on a continuous web of linerless tape of the present invention.
Figure 2:
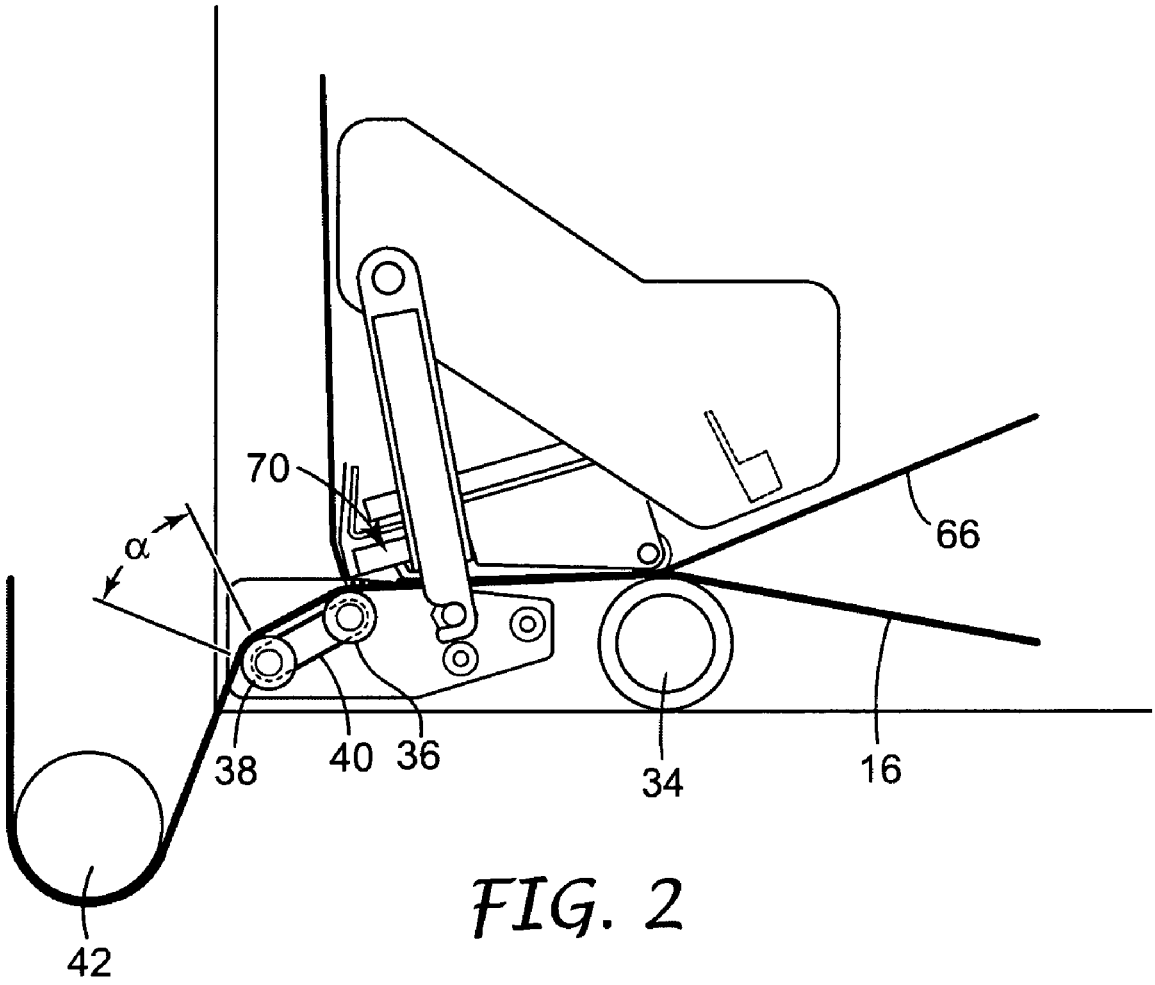
FIG. 2 is an enlarged, schematic, top view of the print head, platen roller and driven roller of FIG. 1.
Figure 3:
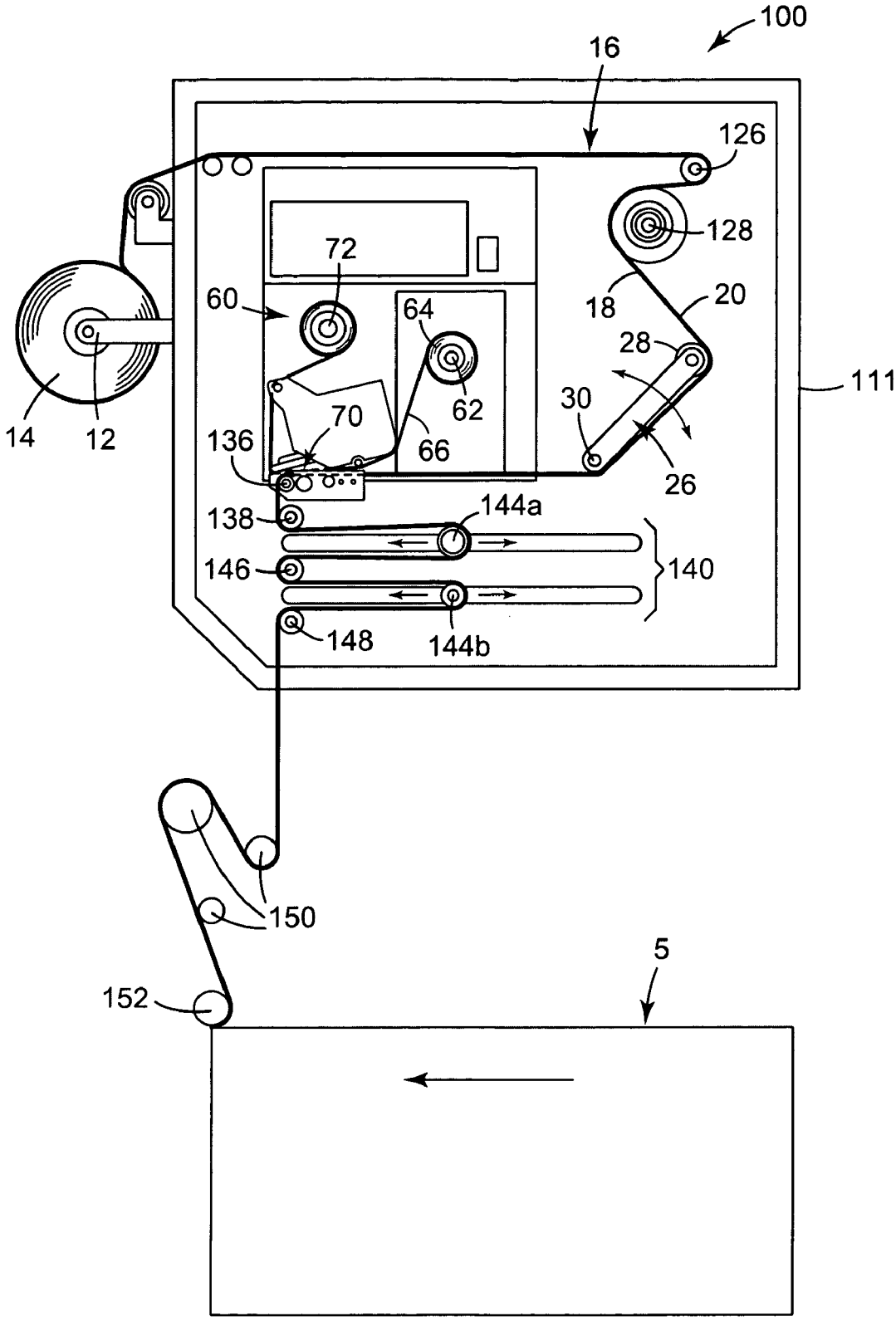
FIG. 3 is a schematic, side view of another embodiment of an apparatus for printing on a continuous web of linerless tape of the present invention.
Figure 4:
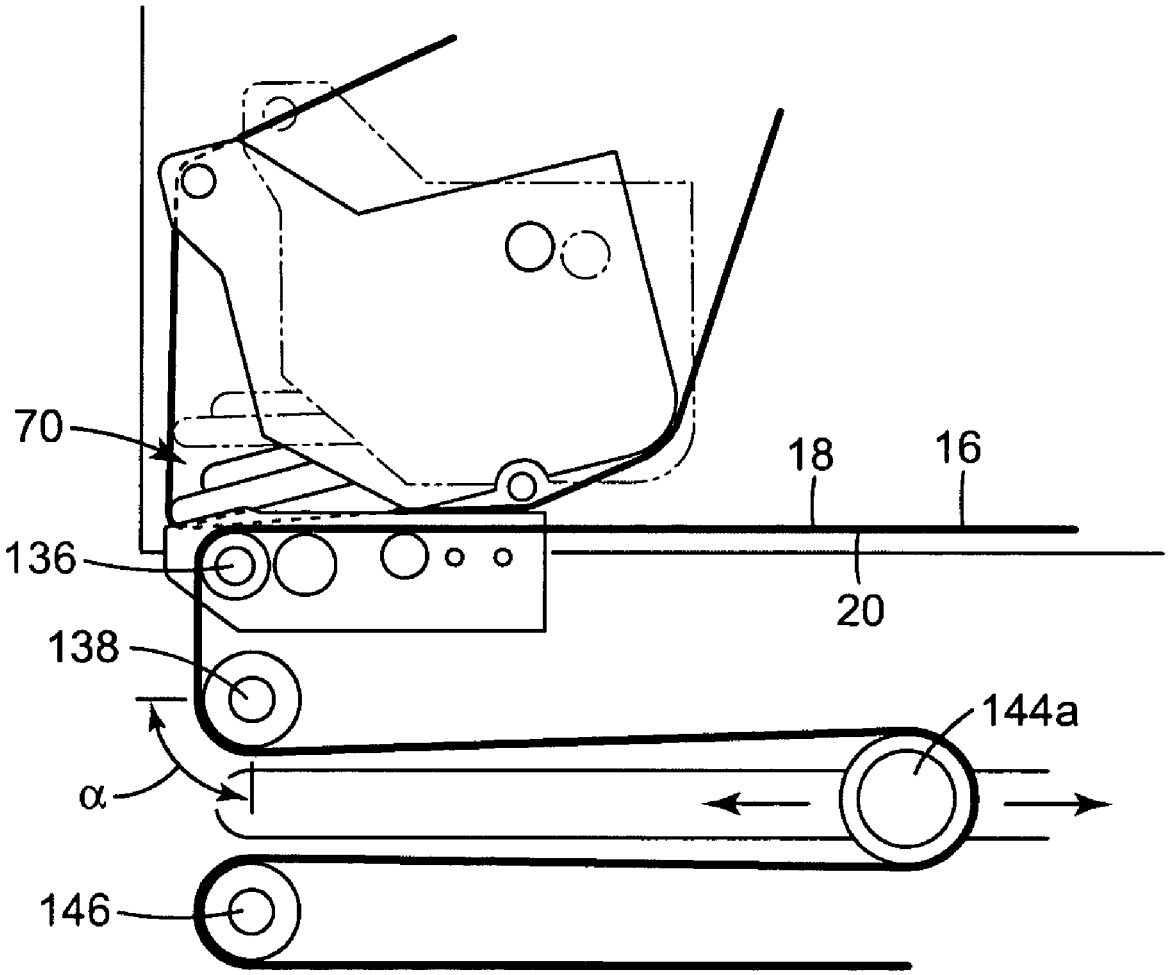
FIG. 4 is an enlarged, schematic, side view of the print head, platen roller and driven roller of FIG. 3.

FIGS. 1 and 2 illustrate an apparatus 10 for printing on a continuous web of linerless tape for subsequent application to an article. FIGS. 3 and 4 illustrate an alternative apparatus 100 for printing on a continuous web of linerless tape for subsequent application to an article. The embodiments of the apparatus 10, 100 may be an apparatus for printing and applying tape, which prints information onto tape to form a length of printed tape and then applies the length of printed tape to an object, preferably a package or a box. The apparatus 10, 100 may vary the information printed on each length of printed tape and may vary the overall length of each length of printed tape, such that different lengths of printed tape may be produced from one supply roll of tape. The apparatus 10, 100 applies the length of printed tape onto an object or article, preferably a package or box, either while the package or box is stationary or while the box is moving (such as while the box is being closed and sealed, as illustrated in FIG. 1). The apparatus 10 can apply the length of printed tape anywhere on the package or box to serve as a conveyor of information. For example, the apparatus 10 can apply the length of printed tape on the top, bottom, or sides of a package or box to convey information about the contents of the box. Alternatively, the apparatus 10 can apply the length of printed tape along a seam of the box to convey information about the contents of the box and to seal the box.

A printing apparatus 60 in accordance with one preferred embodiment of the present invention is illustrated in FIG. 1. As a point of reference, the printing apparatus 60 is, employed to print onto a label tape to define a label segment. Later, the label segment will be applied to an article 5 of interest, such as a box. It will be understood that the article 5 can assume a wide variety of forms, including containers, packages, finished good articles, flats, etc. The term "label tape" is, as described in greater detail below, in general reference to a substrate that is linerless; that can be supplied in a roll (such as a self-wound roll); and that is not pre-cut. Because, in roll form, the label tape typically does not include printing and is supplied as a continuous web, the terms "web of linerless tape" or simply "tape" can be used interchangeably with the term "label tape". The term "label segment" is used to mean a portion of a continuous web of linerless label tape that can convey information (such as by printing) and that can be affixed to a surface. Label segments include the tape after it is printed (if it is to be printed), both before and after it is severed from a remainder of the continuous web.

In general terms, the apparatus 10 includes a web of linerless tape 16, a tape supply holder or roller 12, a first dancer arm 26, a prestrip driven roller 24, idle guide rollers 22, 32, and 34, a platen roller 36, a print apparatus 60, a driven roller 38, a second dancer arm 44, idle guide rollers 42, 46, 48, 49, 50, 52, 54, and 58, an applicator 80, a cutter 90, and a housing 11 maintaining all of the components. All of the components are described in greater detail below. In general terms, however, the web of linerless tape 16 is initially provided as a roll 14 otherwise supported by the tape supply holder 12. The driven roller 24 is driven by a motor (not shown) and assists in prestripping or pulling the tape 16 from the tape supply roll 14. The guide rollers 22, 32, and 34 and the dancer arm 26 direct the web of linerless tape 16 to the platen roller 36, which in turn guides the web of linerless tape 16 past the print head 70 for printing thereon. The driven roller 38 pulls the web of linerless tape 16 from the platen roller 36 and directs it to the idle guide roller 42, followed by the second dancer arm 44, and a series of more idle guide rollers. The applicator 80 (such as a vacuum pad) receives the web of linerless tape, where it subsequently cuts the tape with cutter 90 and applies a label segment to the article 5, preferably a box.

Each dancer arm 26, 44 includes idle guide rollers 28, 46, 48 on each end, opposite the dancer arm's pivot 30, 47. The dancer arm functions to assist in keeping the web of linerless tape 16 under tension and under control throughout the tape path. The movement of idle guide roller 46 of the second dancer arm 44 is restricted within the slot 45. Examples of exemplary first dancer arm 26, second dancer arm 44, and prestrip roller 24, their associated sensors (not shown), and interaction with the print apparatus 60 are taught in U.S. Pat. No. 6,415,842 (Vasilakes et al.), "System for Printing and Applying Tape onto Surfaces," which is hereby incorporated by reference.

The web of linerless tape 16 travels from the series of guide rollers 50, 52, 54, and 58 to the applicator 80. The applicator 80 works in conjunction with the cutter 90 and together they function to cut the web of linerless tape 16 into tape segments and to apply them to an object, such as a box 5. An example of an exemplary applicator 80 and cutter 90 is taught in U.S. Pat. No. 6,537,406 (Jensen, Jr. et al.), "Vacuum-Assisted Tape Applicator," which is hereby incorporated by reference.

The web of linerless tape 16 can be a single-coated pressure sensitive adhesive tape or media having a multiple layer construction including a backing layer. The backing layer can be, for example, a single or multiple layer plastic-film backing. Suitable plastic film backings include polypropylene, polyethylene, copolymers of polypropylene and polyethylene, polyvinyl chloride (PVC), polyesters, and vinyl acetates. The polypropylene can include monoaxially-oriented polypropylene (MOPP), biaxially-oriented polypropylene (BOPP), or sequentially or simultaneously biaxially-oriented polypropylene (SBOPP). The backing material can be compostible, degradable, colored, printed, and can be of different surface textures or embossed. Pressure sensitive adhesive is preferably coated onto one side of the backing and a release coating (such as low adhesion back size (LAB) layer) is optionally coated on the opposite side to allow the tape to unwind from itself when wound in a roll. Alternatively, the linerless tape 16 can have a limited tackiness.

As will be understood by one of ordinary skill in the art, the exact construction of the web of linerless tape 16 can assume a wide variety of forms. In a preferred embodiment, however, the web of linerless tape 16 is highly thin, having a thickness of less than approximately 90 microns (3.5 mils). One example of an acceptable linerless tape is sold under the trade name "3340 Scotch® Printable Tape" by 3M. Notably, however, the apparatus 10, is equally useful with thicker linerless tape.

With this description in mind, the web of linerless tape 16 is defined by a print side 18 and an adhesive side 20. The print side 18 is configured to receive indicia from the print apparatus 60, whereas the adhesive side 20 preferably carries an adhesive properly configured to secure a segment (e.g., the label segment) of the linerless tape 16 to a surface, such as a surface of the box 5, although the adhesive side 20 alternatively is of limited tackiness. Where employed, many types of adhesives can be used, and the adhesive is preferably a pressure sensitive adhesive. Pressure sensitive adhesives are normally tacky at room temperature and can be adhered to a surface by application of, at most, light finger pressure. Alternatively, an activatable or other type of adhesive can be used, as is known in the art.

The web of linerless tape 16 is preferably provided as a roll 14 that is rotatably maintained within the housing 11 by a tape supply holder 12 (shown generally in FIG. 1). A layer or strip of the web 16 is "pulled" from the roll 14 and transported through a tape path defined by the guide rollers 22, 24, 28, 32, and 34. The guide rollers 22, 24, 28, 32, and 34 are undriven idle rollers of a type(s) known in the art they are positioned to contact or engage the linerless tape 16. In general terms, the guide rollers 22, 24, 28, 32, and 34 are provided to create or control a tension in the linerless tape 16 upstream of the platen roller 36 and the print head 70. Thus, the guide rollers 22, 24, 28, 32, and 34 can assume a wide variety of forms and locations, and can contact either the print side 18 or the adhesive side 20. In one preferred embodiment, the guide roller 24 is a pre-stripper roller and the guide roller 28 is an accumulator roller. The pre-stripper roller 24 is optionally a driven roller controlled by a position of the accumulator roller 28. With this one preferred configuration, the rollers 22, 24, and 28 work in concert to eliminate "chatter" or "shockiness" in the linerless tape 16 at the print apparatus 60 by achieving a consistent "pull" off of the roll 14. Alternatively, the rollers 22, 24, and 28 need not include a pre-stripper roller and/or an accumulator roller. Even further, while five of the guide rollers are illustrated in FIG. 1, any other number, either greater or lesser, is equally acceptable. Further, additional guide components, such as plates, arms, festoons, etc., can also be included to create desired positioning and/or tension in the linerless tape 16 upstream of the platen roller 36.

The platen roller 36 is preferably rotatably driven (preferably counter-clockwise in the orientation of FIG. 1). The platen roller 36 preferably has an outer diameter in the range of approximately 1.3–2.54 cm (0.5–1 inch). As described in greater detail below, the platen roller 36 is positioned to guide the linerless tape 16 past the print apparatus 60 for printing on the print side 18 thereof. Thus, the platen roller 36 is configured to receive the adhesive side 20 of the linerless tape 16. In the preferred embodiment of FIG. 1, the platen roller 36 is positioned directly beneath a print head 70 portion of the print apparatus 60, such that the platen roller 36 supports the linerless tape 16 during a printing operation by the print head 70. Alternatively, however, the platen roller 36 is positioned slightly upstream or downstream of the print head 70. In this regard, the roller 36 may be something other than a "platen" roller, as that term is commonly used. As used herein, including the claims, when referring to a "platen roller", this means it is a roller most closely positioned to the print head 70. Thus, the platen roller 36 is associated with the print head 70.

The print apparatus 60 is of a type known in the art, and preferably includes the print head 70 electrically connected to a controller (not shown). Based on input, the controller controls the print head 70 to print desired indicia (e.g., alphanumeric, bar codes, images, logos, other printed information, etc.) on the print side 18 of the linerless tape 16. In one preferred embodiment, the print apparatus 60 is a thermal transfer printer, such as model 110PAX3 from Zebra Corporation (Vernon Hills, Ill.) or a similar printer or print engine with or without modification and includes a ribbon 66, a ribbon supply holder or roller 62, one or more ribbon guides 68*a*, 68*b*, and a ribbon take-up roller 72. The ribbon 66 extends from the supply roller 62 about the first ribbon guide 68*a*, print head 70, the second ribbon guide 68*b*, and to the take-up roller 72. Thus, the ribbon 66 is directed between the print head 70 and the linerless tape 16 for effectuating printing by the print head 70 on the linerless tape 16. Alternatively, the print apparatus can assume other forms known in the art. For example, the print apparatus 60 can be an ink jet printer, such that the print head 70 is an ink jet print head. Alternatively, direct thermal, impact, or other print systems are equally applicable.

The driven roller 38 is positioned adjacent the platen roller 36 downstream of the print head 70. In one preferred embodiment, the driven roller 38 includes a contact surface, which is configured to minimize adhesion with the adhesive side 20 of the linerless tape 16. In a more preferred embodiment, the outer contact surface of the driven roller 38 is a knurled surface, for example the contact surface includes a plurality of raised and lowered portions. When the adhesive side 20 of the linerless tape 16 contacts the knurled surface, it only contacts the raised portions of the contact surface, thus minimizing the surface area where the adhesive side 20 of the linerless tape 16 and driven roller 38 contact.

The relationship and operation of the driven roller 38 relative to the platen roller 36 is shown more clearly by the enlarged, top view of FIG. 2. The driven roller 38 operates to pull the linerless tape 16 from the platen roller 36. In the view of FIG. 2, wrap angle $\alpha$ reflects the angle around the driven roller 38 between where the linerless tape first contacts the driven roller 38 and where the linerless tape leaves the driven roller 38 towards the idle roller 42. With this starting point in mind, the driven roller 38 is positioned relative to the platen roller 36 to allow the linerless tape 16 to partially wrap about the driven roller 38, which assists in pulling the linerless tape 16 off of the platen roller 36. This wrap angle $\alpha$ of the web of linerless tape 16 along the driven roller 38 is preferably between 10°–180°. More preferably, wrap angle $\alpha$ of the web of linerless tape 16 along the driven roller 38 is between 10°–45°. This preferred wrap angle promotes a positive pull or tension on the linerless tape 16 from the platen roller 36. Alternatively, other wrap angles are also acceptable, either greater or lesser.

In one preferred embodiment, the platen roller 36 is a driven platen roller. It should be understood that, when referring to a roller as being "driven," as used herein, including the claims, this means that it is rotating as a result of some mechanical drive motor ultimately controlling its rotation, whether it be by direct connection to a drive motor, or through an indirect connection to a drive motor through one or a series of belts or gears. In contrast, when referring to a roller as "undriven" or "idle," this means that the roller is not connected to a drive motor, either directly or indirectly, and freely rotates on its own, for example, as a result of the linerless tape contacting the roller as it moves along a tape path, causing the roller to rotate.

Preferably, the platen roller 36 and the driven roller 38 include a belt 40 connecting them together. In one preferred embodiment, the platen roller 36 includes its own drive motor (not shown), which is operatively connected with the print apparatus 60. When the controller causes the print head 70 of the print apparatus 60 to start printing, the controller likewise sends a signal to the drive motor to start rotating the platen roller. In this embodiment, the driven roller 38 does not include its own drive motor. Instead, the driven roller 38 is rotated or driven indirectly by the drive motor connected to the platen roller 36 by use of the belt 40 connecting the platen roller 36 and the drive roller 38. The belt 40 advantageously drives the driven roller 38 at the same speed of the platen roller 36. More preferably, the diameter of the platen roller 36 is less than or equal to the diameter of the driven roller 38 because this allows the driven roller 38 to be driven at a slightly greater surface speed than the platen roller 36, for example preferably at least 101% to 102% of the surface speed of the platen roller 36. This preferred operational characteristic assists in establishing and maintaining the desired tension or positive pull on the linerless tape 16 as it extends from the platen roller 36 because this allows the tape to be pulled from the platen roller 36 at a faster rate than the platen roller 36 is rotating. In addition, this preferred operational characteristic ensures a positive pull or tension on the linerless tape 16 that prevents the linerless tape 16 from "slipping back" and wrapping about the platen roller 36 beyond the desired wrap position previously described.

In another alternative embodiment, the platen roller 36 is not connected with any drive motor. Instead, the driven roller 38 includes its own drive motor, which is operatively connected with the print apparatus 60. In this embodiment, when the controller sends a signal to the print head 70 to start printing, the controller also send a signal to the drive motor to start rotating or driving the drive roller 38. As a consequence, the belt 40 rotates the platen roller 36 simultaneously. Thus, the drive motor connected to the driven roller 38 is indirectly driving the platen roller 36, through use of the belt 40, making the platen roller 36 a driven roller. In this embodiment, the discussion above about relative diameters and surface speeds of the platen roller 36 and the driven roller 38 equally applies to obtain the preferred operational characteristic assists of establishing and maintaining the desired tension or positive pull on the linerless tape 16 as it extends from the platen roller 36.

In yet another alternative embodiment, the apparatus 10 could not include a belt 40. Instead, the platen roller 36 and the driven roller 38 could each include their own separate and independent drive motors. In this embodiment, when the controller sends a signal to the print head 70 to start printing, the controller also send signals to both the drive motors to each start rotating or driving the platen roller 36 and drive roller 38. Similarly, in this embodiment, the discussion above about relative diameters and surface speeds of the platen roller 36 and the driven roller 38 equally applies to obtain the preferred operational characteristic assists of establishing and maintaining the desired tension or positive pull on the linerless tape 16 as it extends from the platen roller 36.

In yet another alternative embodiment, the apparatus would not include a belt 40. Instead, only the driven roller 38 would be driven, for example by its own drive motor. A motor would not drive the platen roller 36, either directly or indirectly. Instead, the platen roller 36 would be an idle guide roller, which freely rotates as the linerless tape 16 moved past it. In this embodiment, the drive roller 38 pulls the tape 16 past the print head 70 along the platen roller 36 and pulls the tape 16 from the platen roller 36. This configuration is advantageous because it separates the drive function from the platen roller and allows it to become an idle roller, which moves easily with the tape as it travels along the tape path. With other prior printing apparatuses in the art, the platen roller typically becomes worn over time because it is pulling or rubbing against the adhesive side 20 of the tape. As the platen roller becomes worn, the non-stick coating, or the outside of the platen roller, such as silicone, begins to wear off and the tape starts sticking to the platen roller. With the apparatus 10 as describe above, the surface characteristics of the platen roller 36 are not as critical because the drive roller 38 pulls the tape reliably from the platen roller 36, resulting in longer life of the platen roller.

Preferably, the platen roller 36 is made of a smooth, conformable material, such as an elastomer. With this construction, the platen roller 36 maintains contact with the adhesive side 20 the linerless tape 16, but does not alter or otherwise deteriorate the adhesive thereon.

Preferably, the platen roller 36 and the driven roller 38 each include a one-way clutch bearing, which is known in the art. In particular, it is advantageous to have the one-way clutch bearing in the platen roller 36 so that the drive motor connected to the platen roller only provides drive when the surface speed of the platen roller is equal to or less than the surface speed of the driven roller 38.

FIG. 3 illustrates an alternative apparatus 100 for printing on a continuous web of linerless tape, which is very similar to the apparatus 10 described in FIGS. 1–2 and includes many of the same or similar components. The apparatus 100 may be an apparatus for printing and applying tape, which prints information onto tape to form a length of printed tape and then applies the length of printed tape to an object, preferably a package or a box, similar to the apparatus 10 described above.

In general terms, the apparatus 100 includes a web of linerless tape 16, a tape supply holder or roller 12, an idle guide roller 126, a prestrip driven roller 128, a first dancer arm 26, a platen roller 136, a print apparatus 60, a driven roller 138, a festoon 140 made of a series of dancer arms 144, idle guide rollers 146, 148, and 150, an applicator roller 152, a cutter (not shown), and a housing 111 maintaining all of the components. The majority of the same components are described in greater detail above in respect to apparatus 10 in FIGS. 1–2. In general terms, however, the web of linerless tape 16 is initially provided as a roll 14 otherwise supported by the tape supply holder 12. The prestrip driven roller 128 is driven by a motor (not shown) and assists in prestripping the tape 16 from the tape supply roll 14. The guide rollers 126 and the dancer arm 26 direct the web of linerless tape 16 to the platen roller 136, which in turn guides the web of linerless tape 16 past the print head 70 for printing thereon. The driven roller 138 pulls the web of linerless tape 16 from the platen roller 136 and directs it to the festoon 140 of dancer arms 144*a* and 144*b*, past idle guide roller 146 and 148. A series of guide idle rollers 150 direct the linerless tape 16 to the applicator roller 152, where it subsequently applies the tape to the article 5, preferably a box. Alternatively, the apparatus 100 may include an applicator 80 and cutter 90, similar to that described above in regard to apparatus 10, and to cut and apply the linerless tape to the box.

The print apparatus 60 preferably includes the print head 70 electrically connected to a controller (not shown). Based on input, the controller controls the print head 70 to print desired indicia (e.g., alphanumeric, bar codes, images, logos, other printed information, etc.) on the print side 18 of the linerless tape 16. In one preferred embodiment, the print apparatus 60 is a thermal transfer printer, such as model PE4X from Datarnax Corporation (Orlando, Fla.) or a similar printer or print engine with or without modification and includes a ribbon 66, a ribbon supply holder or roller 62, and a ribbon take-up roller 72. The ribbon 66 extends from the supply roller 62 about print head 70, and to the take-up roller 72. Thus, the ribbon 66 is directed between the print head 70 and the linerless tape 16 for effectuating printing by the print head 70 on the linerless tape 16. Alternatively, the print apparatus can assume other forms known in the art. For example, the print apparatus 60 can be an ink jet printer, such that the print head 70 is an ink jet print head. Alternatively, direct thermal, impact, or other print systems are equally applicable.

The relationship and operation of the driven roller 138 relative to the platen roller 136 of apparatus 100 is shown more clearly by the enlarged, side view of FIG. 4. The driven roller 138 operates to pull the linerless tape 16 from the platen roller 136. In the view of FIG. 4, wrap angle $\alpha$ reflects the angle around the driven roller 138 between where the linerless tape first contacts the driven roller 138 and where the linerless tape leaves the driven roller 138 towards the dancer arm 144 in the festoon 140. With this starting point in mind, the driven roller 138 is positioned relative to the platen roller 136 to allow the linerless tape 16 to partially wrap about the driven roller 138, which assists in pulling the linerless tape 16 off of the platen roller 136. This wrap angle $\alpha$ of the web of linerless tape 16 along the driven roller 138 is preferably between 10°–180°. More preferably, wrap angle $\alpha$ of the web of linerless tape 16 along the driven roller 38 is between 45°–135°, and most preferably 90°. This preferred wrap angle promotes a positive pull or tension on the linerless tape 16 from the platen roller 36. Alternatively, other wrap angles are also acceptable, either greater or lesser.

In one preferred embodiment of apparatus 100, the platen roller 136 is driven by its own separate drive motor (not shown) and the driven roller 138 is driven by its own separate drive motor (not shown). In this embodiment, the discussion above about relative diameters and relative surface speeds of the platen roller 136 and the driven roller 138 equally applies to obtain the preferred operational characteristic assists of establishing and maintaining the desired tension or positive pull on the linerless tape 16 as it extends from the platen roller 136 to the driven roller 138.

In one preferred embodiment, when the controller causes the print head 70 of the print apparatus 60 to start printing, the controller likewise sends a signal to the independent drive motors to start rotating the platen roller 136 and drive roller 138. In an alternative preferred embodiment, when the controller causes the print head 70 of the print apparatus 60 to start printing, the controller only sends a signal to the drive motor to start rotating the platen roller 136. While the print head 70 is printing, the drive motor connected to the driven roller 138 does not operate. Instead, the driven roller will be idle. The linerless tape 16 will continue to travel along the tape path due to the tension created by the dancer arm and the applicator 80 as the tape 16 is applied to the box 5. In one preferred embodiment, both the platen roller 36 and the driven roller 38 include one-way clutch bearings know in the art. However, when the print head 70 is done printing, the print head 70 will rotate away from the platen roller 138 (as illustrated in dotted lines) to be out of contact with the platen roller 136. Then, the drive motor attached to the driven roller 138 will start rotating the driven roller 138 at a high speed and the drive motor attached to the platen roller 136 will turn off, thus making the platen roller an idle roller. This configuration is advantageous in that it allows linerless tape 16 to freely pass by the print apparatus 60 when the print head 70 is not printing.

In yet another preferred embodiment, the platen roller 136 may not have a drive motor connected to it either directly or indirectly. Instead, only the drive roller 138 has a drive motor connected to it. In this embodiment, the drive roller 138 pulls the tape 16 past the print head 70 along the platen roller 36 and pulls the tape 16 from the platen roller 36. In this embodiment, the discussion above about the advantages of separating the drive function from the platen roller equally applies to obtain longer platen roller life.

The apparatuses 10 and 100 are useful with a variety of differently configured printing and applying devices. In this regard, label-printing devices are generally configured as either a "loose loop" device or a "next label segment out" device. The apparatus 10 illustrated in FIG. 1 and apparatus 100 illustrated in FIG. 3 are a loose loop-type design in which a given label segment is printed, but not immediately applied to the article 5. Instead, following printing, the label segment is wound through a tape path defined, for example, by an accumulator or festoon, because it will be applied to an article that is sequentially located behind several as-of-yet unlabelled articles at the time immediately following printing. One or more previously printed label segments must be applied after the given label segment is printed and before the given label segment is applied. One example of an available loose loop device is sold under the trade name "3M-Matic Print/Apply Case Labeling System CA2000" by 3M Company of St. Paul, Minn. However, the apparatuses 10, 100 are also useful with the next label segment out design, whereby after a label segment is printed, it is then immediately applied to the article. One example of a next label segment out device is sold under the trade name "3M-Matic Print/Apply Case Labeling System SA2000" by 3M Company of St. Paul, Minn.

The present invention has now been described with reference to several embodiments thereof. The foregoing detailed description and examples have been given for clarity of understanding only. No unnecessary limitations are to be understood therefrom. All patents and patent applications cited herein are hereby incorporated by reference. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. An apparatus for printing on a continuous web of linerless tape for subsequent application to an article, the continuous web of linerless tape defined by a print side and an adhesive side, the apparatus comprising:

a support for a continuous web of linerless tape;

an undriven platen roller located downstream of the support;

a print head associated with the undriven platen roller, wherein the undriven platen roller directs the continuous web of linerless tape past the print head for printing on the print side thereof; and a driven roller positioned adjacent the platen roller and downstream of the print head for pulling the web of linerless tape from the platen roller;

wherein the driven roller does not form a nip with another roller.

2. The apparatus of claim 1, wherein the adhesive side carries an adhesive, wherein the driven roller includes a contact surface for engaging the linerless tape, and wherein the contact surface is configured to minimize adhesion with the adhesive side.

3. The apparatus of claim 2, wherein the contact surface includes a knurled surface for minimizing a surface area of the contact surface.

4. The apparatus of claim 1, wherein the apparatus is configured to process linerless tape having a thickness less than 90 microns.

5. The apparatus of claim 1, wherein the driven roller is positioned relative to the platen roller to define a wrap angle of the web of linerless tape around the driven roller of between 10°–180°.

6. The apparatus of claim 1, wherein the print head is a thermal transfer print head and the apparatus further comprises a ribbon, passed between the print head and the web of linerless tape for printing on the print side thereof.

7. The apparatus of claim 1, wherein the platen roller is opposite the print head for supporting the linerless tape during a printing operation.

8. The apparatus of claim 1, wherein the driven roller is positioned relative to the platen roller such that the web of linerless tape wraps at least partially around the driven roller.

9. The apparatus of claim 1, wherein the apparatus is configured such that the undriven platen roller is free to rotate as the driven roller pulls the web of linerless tape from the undriven platen roller.

10. A method of printing indicia on a continuous web of linerless tape for subsequent application to an article, the web of linerless tape defined by a print side and an adhesive side, the method comprising:

providing a print head associated with an undriven platen roller;

providing a driven roller, positioned adjacent the platen roller downstream of the print head, wherein the driven roller does not form a nip with another roller;

providing a continuous web of linerless tape;

extending the web of linerless tape along a tape path from the undriven platen roller to the driven roller such that the undriven platen roller contacts the adhesive side and the driven roller contacts the adhesive side;

rotating the driven roller to drive the web of linerless tape past the print head and to pull a portion of the web of linerless tape from the platen roller; and printing indicia on the print side with the print head.

11. The method of claim 10, wherein providing a continuous web of linerless tape includes providing a web of linerless tape having a thickness of less than about 90 microns.

12. The method of claim 10, wherein providing a web of linerless tape includes providing a web of linerless tape carrying an adhesive on the adhesive side.

13. The method of claim 10, wherein extending the web of linerless tape along a tape path includes establishing a wrap angle of linerless tape around the driven roller between 10°–180°.

14. The method of claim 10, wherein the printing device is a thermal transfer printer and further includes a continuous ribbon disposed between the print head and the print side of the web of linerless tape.

15. The method of claim 10, wherein the adhesive side carries an adhesive, and wherein the driven roller includes a contact surface for engaging the linerless tape, the contact surface being configured to minimize adhesion with the adhesive side.

16. The method of claim 15, wherein the contact surface includes a knurled surface for minimizing the surface area of the contact surface.

17. The method of claim 10, wherein rotating the driven roller to drive the web of linerless tape past the print head includes rotating a single driven roller.

18. The method of claim 10, wherein rotating the driven roller to drive the web of linerless tape past the print head includes pulling a portion of the web of linerless tape from a freely rotating platen roller.

19. The method of claim 18, wherein pulling a portion of the web of linerless tape from a freely rotating platen roller includes moving the freely rotating platen roller at a surface speed that is about equal to a speed that the web of linerless tape moves along the tape path.

* * * * *